US005205526A

United States Patent [19]

Deutsch

[11] Patent Number: 5,205,526

[45] Date of Patent: Apr. 27, 1993

[54] COLLAPSIBLE DISPLAY EASEL

[75] Inventor: Dennis Deutsch, Hastings, Minn.

[73] Assignee: Pierce Companies, Inc., Santa Ana, Calif.

[21] Appl. No.: 831,485

[22] Filed: Feb. 5, 1992

[51] Int. Cl.[5] ..... A47B 97/04

[52] U.S. Cl. ..... 248/449; 248/188.8; 248/452; 248/453; 248/464; 248/465

[58] Field of Search ..... 248/448, 449, 451, 452, 248/453, 460, 464, 465, 163.1, 431, 166, 173, 188.6, 188.8, 188.9, 188.91

[56] References Cited

U.S. PATENT DOCUMENTS

| | | | |
|---|---|---|---|
| 2,480,952 | 9/1949 | Nilsson | 248/465 X |
| 3,368,786 | 2/1968 | Bulman | 248/465 X |
| 4,690,363 | 9/1987 | Koves | 248/449 |
| 5,003,328 | 3/1991 | Gaynor | 248/188.8 X |

FOREIGN PATENT DOCUMENTS

| | | | |
|---|---|---|---|
| 0923264 | 4/1963 | United Kingdom | 248/460 |

*Primary Examiner*—Ramon O. Ramirez
*Attorney, Agent, or Firm*—Price, Gess & Ubell

[57] ABSTRACT

A collapsible display easel is provided which can be easily extended into a sturdy, erect easel for holding display material, and easily retracted and folded into a compact configuration for transport. The display easel includes a two-legged supporting stand, a vertical brace, and one or more crossbar members. The display material is held against the vertical brace between the crossbar members. The legs are provided with extending support feet for securely supporting the easel in an upright position. The various components are connected by sliding or pivoting attachment mechanisms which allow the components to be easily extended or retracted. The sliding and pivoting connection mechanisms are manually operable and do not require the use of any tools or special equipment. The display easel is retracted into a compact configuration solely by pivoting or sliding the various components with respect to each other, and does not require the disassembly of any of the components. Thus, the display easel provides a sturdy, lightweight easel for displaying relatively large display materials, yet which can quickly and easily be retracted into a compact, lightweight configuration for easy transport. A carrying case is also provided.

22 Claims, 7 Drawing Sheets

FIG. 1
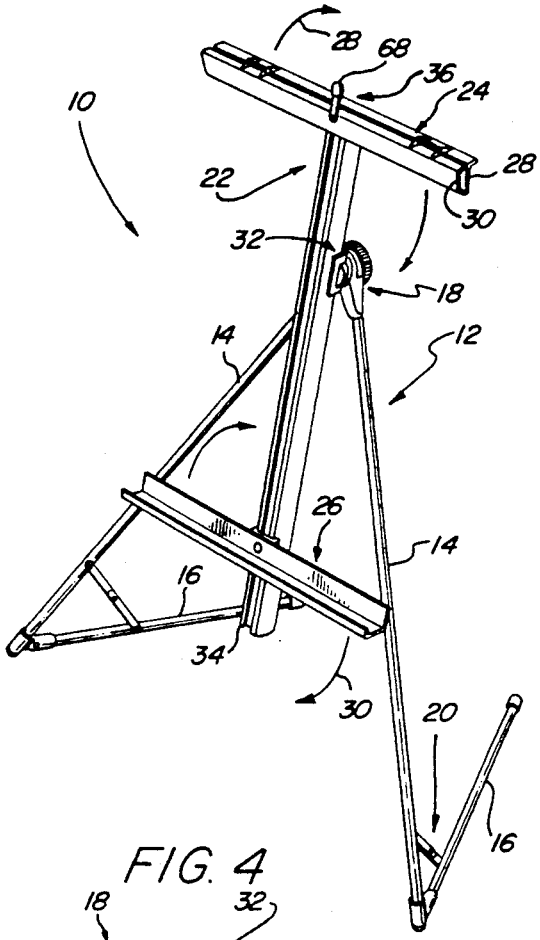
FIG. 2
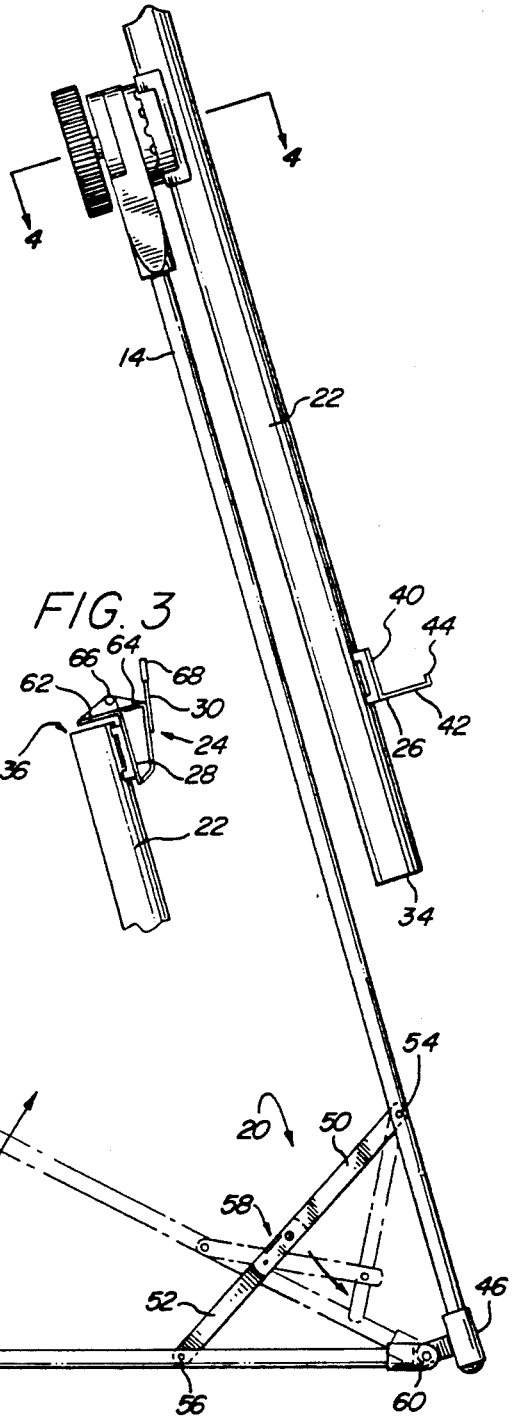
FIG. 3
FIG. 4
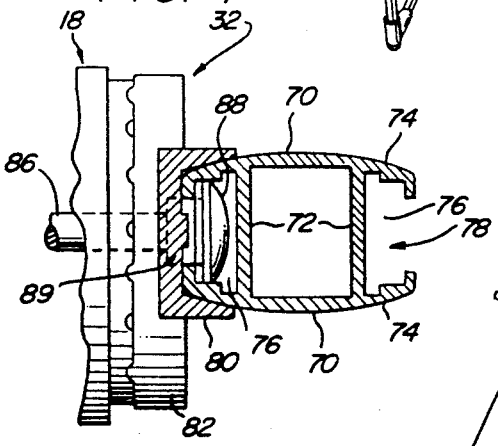

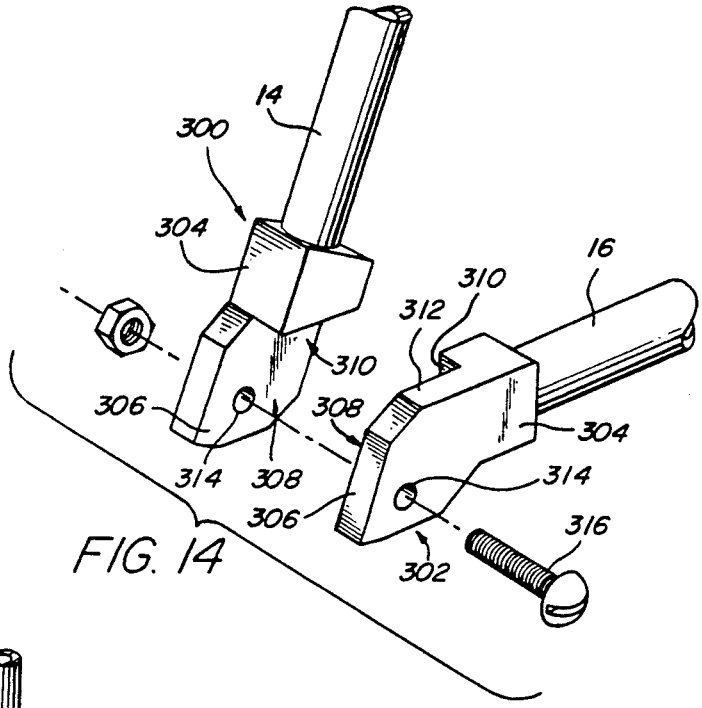
FIG. 14
FIG. 16
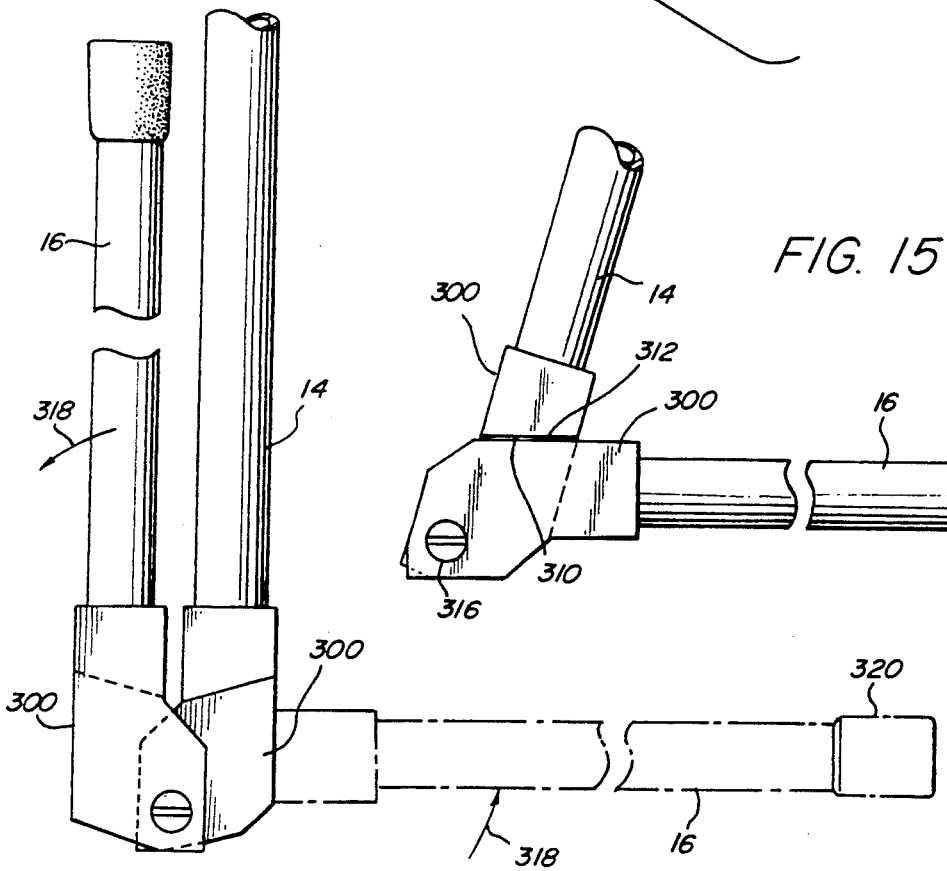
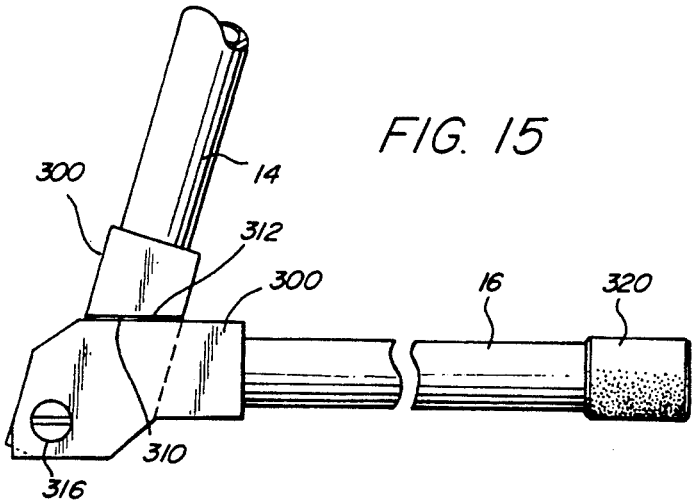
FIG. 15

417
406
414
408
406
414
402
432
408
407
400
407
405
438
416
488
489
405
404
438
404
14
489
436
14
436
480
434

400
408
480
488
402
436
438
436
438
405
438
14
14

400
408
480
488
402
438
405
438
405
14
14

COLLAPSIBLE DISPLAY EASEL

BACKGROUND OF THE INVENTION

1. Field of the Invention

The present invention relates generally to improvements in display easels and, more particularly, pertains to a new and improved display easel capable of being folded into a compact configuration for easy transport.

2. Description of Related Art

Conventional display easels are commonly large and bulky and consume considerable floor space when not in use. Various attempts have been made to design display easels which may be folded, retracted, or collapsed into a smaller, more manageable size. Often, however, these display easels are only marginally collapsible, i.e., tripod legs are provided which may be collapsed into a parallel configuration, whereas remaining portions of the easel are not collapsible. Display easels which are only partially collapsible do not save sufficient floor space when collapsed, and are not easily transported.

Other display easels have been developed which are more completely collapsible. However, such display easels often require dismantling the easel for transport, i.e., the tripod legs of the easel must be completely removed prior to transport. Disassembly is often difficult and time consuming and requires the use of tools, such as screwdrivers and wrenches, which may not be readily at hand. Further, once disassembled, the display easels often are not easily reassembled. Parts of the easels, such as small screws and bolts, are easily misplaced. Moreover, written instructions must often be followed for proper disassembly and reassembly. The written instructions may also be lost or misplaced, rendering the assembly or disassembly of the easel even more challenging.

SUMMARY OF THE INVENTION

The present invention overcomes the disadvantages of the prior art by providing a collapsible display easel which may be folded and retracted into a convenient compact size for easy transport without disassembly. The display easel of the invention is collapsible into a compact configuration by merely folding, pivoting, and retracting elements of the easel. No tools are required for erecting or collapsing the display easel. Further, the easel is provided with a display stand having only two legs, rather than the conventional three-legged tripod stand. By using a two-legged stand, the display easel is collapsible into a smaller and lighter configuration than the three-legged display easels of the prior art.

In accordance with a preferred embodiment, the display easel includes a pair of support legs, a vertical brace, and a crossbar having means for holding a display board. The crossbar is provided with means for pivotably mounting the crossbar to the brace and the brace is provided with mounting means for slidably mounting the brace to the legs. The legs include connection means for pivotably connecting one leg to the other. Accordingly, the legs may pivot until parallel with each other, the crossbar may pivot until parallel with the brace, and the brace may slide with respect to the legs, thus yielding a highly compact configuration for transport.

The crossbar may be provided with clamping means for holding a display board. Alternatively, the crossbar may include a shelf for supporting a display board. Optionally, two crossbars may be provided, with an upper crossbar having a clamping means and the lower crossbar having a shelf.

To connect the brace to the legs, a slotted track is provided longitudinally along an edge of the brace. A shoulder bolt having a rectangular shoulder connects the brace to upper ends of the legs. A head of the shoulder bolt is slidably received within the track, while the shoulder of the shoulder bolt is closely received within the slot such that a smooth and secure sliding of the brace is achieved with respect to the legs. A similar engaging track and shoulder bolt mechanism may be provided to attach the crossbar to the brace, thus allowing the crossbar to slide, as well as pivot, with respect to the base.

The two support legs are each preferably provided with an extending support foot. Each foot is pivotably attached to a support leg by means such as a folding table hinge for allowing the foot to be collapsed until parallel with the leg. For display, each foot is pivoted outwardly from the leg and secured at an angle such that the legs may lean against, and be supported by, the feet.

The connecting means for pivotably connecting the legs of the display easel preferably includes a pair of engaging pivot members formed on top ends of the legs. The engaging pivot members allow the legs to be pivoted from a collapsed configuration wherein the legs are parallel with each other, and an erect configuration wherein the legs are spread at an angle for maximum support. A coupling connects the pivot members to the brace of the display easel. The coupling may be provided with radially-extending ribs which engage radially-extending slots within one of the pivot members such that the brace may be pivoted to discrete angles with respect to the legs.

Thus, the invention provides an improved display easel which can be collapsed into a compact configuration with all components lying parallel and adjacent to each other, and expanded into an erect configuration wherein the components are extended for use. The display easel is collapsed or expanded merely by loosening and tightening various bolts and folding, retracting, or pivoting the various easel components with respect to each other. Thus, the easel remains intact and no components need to be removed or detached from the easel at any time. The bolts are preferably provided with knobs for easy manual tightening or loosening such that no tools are required. A convenient carrying case is provided for carrying the easel in its collapsed configuration.

BRIEF DESCRIPTION OF THE DRAWINGS

The exact nature of this invention, as well as its objects and the advantages thereof, will become readily apparent from the following description when considered in conjunction with the accompanying drawings, in which like reference numerals designate like parts throughout the figures thereof, FIG. 1 is a perspective view of a collapsible display easel constructed with a preferred embodiment of the invention, showing display easel expanded for use;

FIG. 2 a side elevational view of a portion of the display easel of FIG. 1, in particular showing the supporting legs of display easel;

FIG. 3 is a side elevational view of a top portion of the display easel, particularly showing a crossbar clamping plate of the invention;

FIG. 4 is a partial cross-sectional view of the embodiment of FIG. 2, taken along line 4—4 and showing a means by which the vertical brace of the display easel is connected to the support legs of the display easel;

FIG. 14 is a perspective exploded view of an alternative pivot joint connecting the support feet to the support legs of the invention;

FIG. 15 is a side elevational view of the alternative pivot joint of FIG. 13, shown in an open configuration with a support foot extending outwardly from a display leg;

FIG. 16 is a side elevational view of the alternative pivot joint of FIG. 13, showing the pivot joint in a closed configuration with a support foot parallel, and adjacent to, a support leg;

DESCRIPTION OF THE PREFERRED EMBODIMENTS

Figure 5:
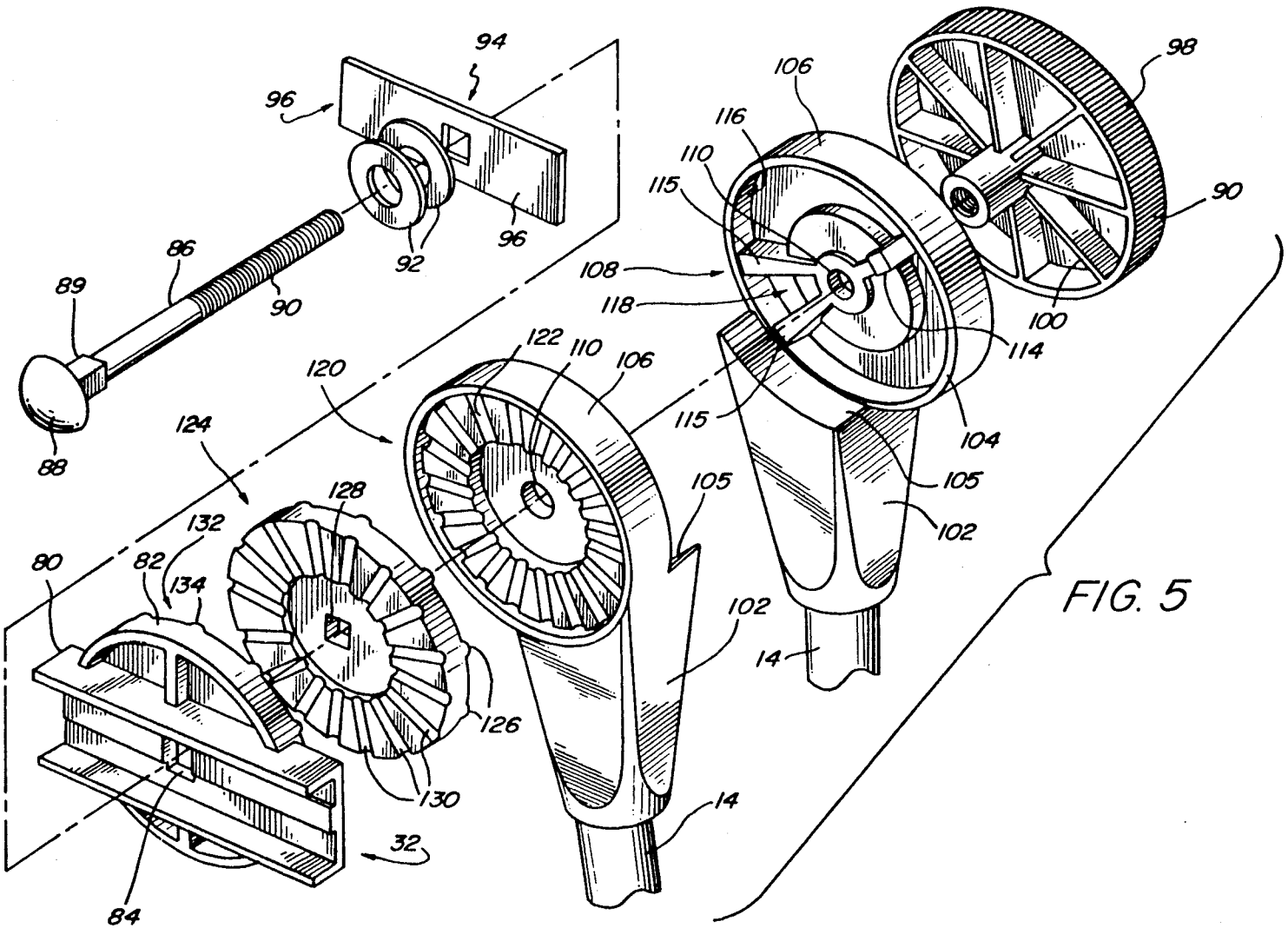
FIG. 5 is an exploded view of a portion of the display easel of FIG. 1, showing a leg connection mechanism by which the support legs are pivotably connected to each other.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a collapsible display easel capable of being collapsed into a compact transportable configuration without disassembly.

In FIG. 1, a preferred embodiment of a display easel 10 is shown. Display easel 10 includes a supporting stand 12 comprised of a pair of support legs 14 and support feet 16. Support legs 14 are connected along top ends thereof by a leg connection mechanism 18. Support feet 16 are connected to legs 14 by a hinge 20.

Leg connection mechanism 18 allows the legs to be pivoted from an open configuration shown in FIG. 1 to a closed configuration with legs 14 oriented parallel with each other. Likewise, hinges 20 allow feet 16 to be pivoted from an expanded position shown in FIG. 1, wherein feet 16 extend outwardly from legs 14 to a collapsed configuration, wherein feet 16 lie parallel with legs 14.

Display easel 10 includes a brace 22 connected to display stand 12 along the top ends of legs 14. A clamping crossbar 24 is attached near a top end 36 of brace 22, and a crossbar shelf 26 is mounted near a lower end 34 of brace 22. Clamping crossbar 24 includes a base plate 28 and a clamping member 30.

In use, a display board (not shown) is rested upon crossbar shelf 26 and leaned against brace 22. A top edge of the display board is secured by clamping crossbar 24. In this manner, the display board is securely and conveniently positioned for display.

As shown by arrows 28 and 30 of FIG. 1, both clamping crossbar 24 and shelf crossbar 26 may be pivoted with respect to brace 22 until parallel with brace 22. Further, brace 22 is connected to supporting stand 12 by a sliding attachment mechanism 32, allowing brace 22 to slide with respect to leg connection mechanism 18. With the provision of sliding attachment mechanism 32, brace 22 may be raised until lower end 34 of brace 22 is positioned near the top of display stand 12. In such configuration, brace 22 and attached crossbars 24 and 26 are maximally raised to position a display board at a substantial height to allow viewing of the display board in, for example, a crowded room.

Alternatively, although not shown in FIG. 1, brace 22 may be lowered until upper end 36 of brace 22 is even with leg connection mechanism 18 such that brace 22 depends from leg connection mechanism 18. Such a configuration is ideally suited for circumstances wherein display easel 10 is rested upon a table or the like, such that a display board may be conveniently displayed without raising brace 22.

Figure 12:
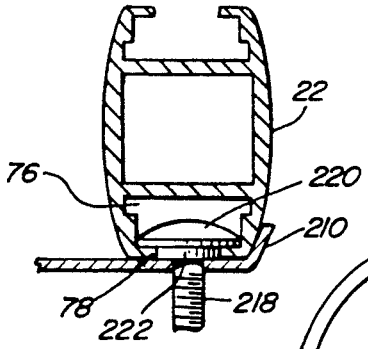
FIG. 12 is a cross-sectional view of the alternative clamping crossbar of FIG. 9, shown mounted to the vertical brace of the display easel.

In addition to sliding attachment mechanism 32, which attaches brace 22 to support stand 12, clamping crossbar 24 is also mounted to brace 22 via a sliding attachment mechanism described below with reference to FIG. 12, and shelf crossbar 26 is mounted to brace 22 by another sliding attachment mechanism. Thus, both crossbars are positionable along the length of brace 22 such that a display board of arbitrary tray size may be securely held in position between the two crossbars. In an alternative embodiment (not shown), clamping crossbar 24 is not used; rather, a display board is merely supported by shelf crossbar 26. Alternatively, and also not shown, shelf crossbar 26 is not used; rather, a display board is merely hung from clamping crossbar 24 without a lower shelf support.

Figure 8:
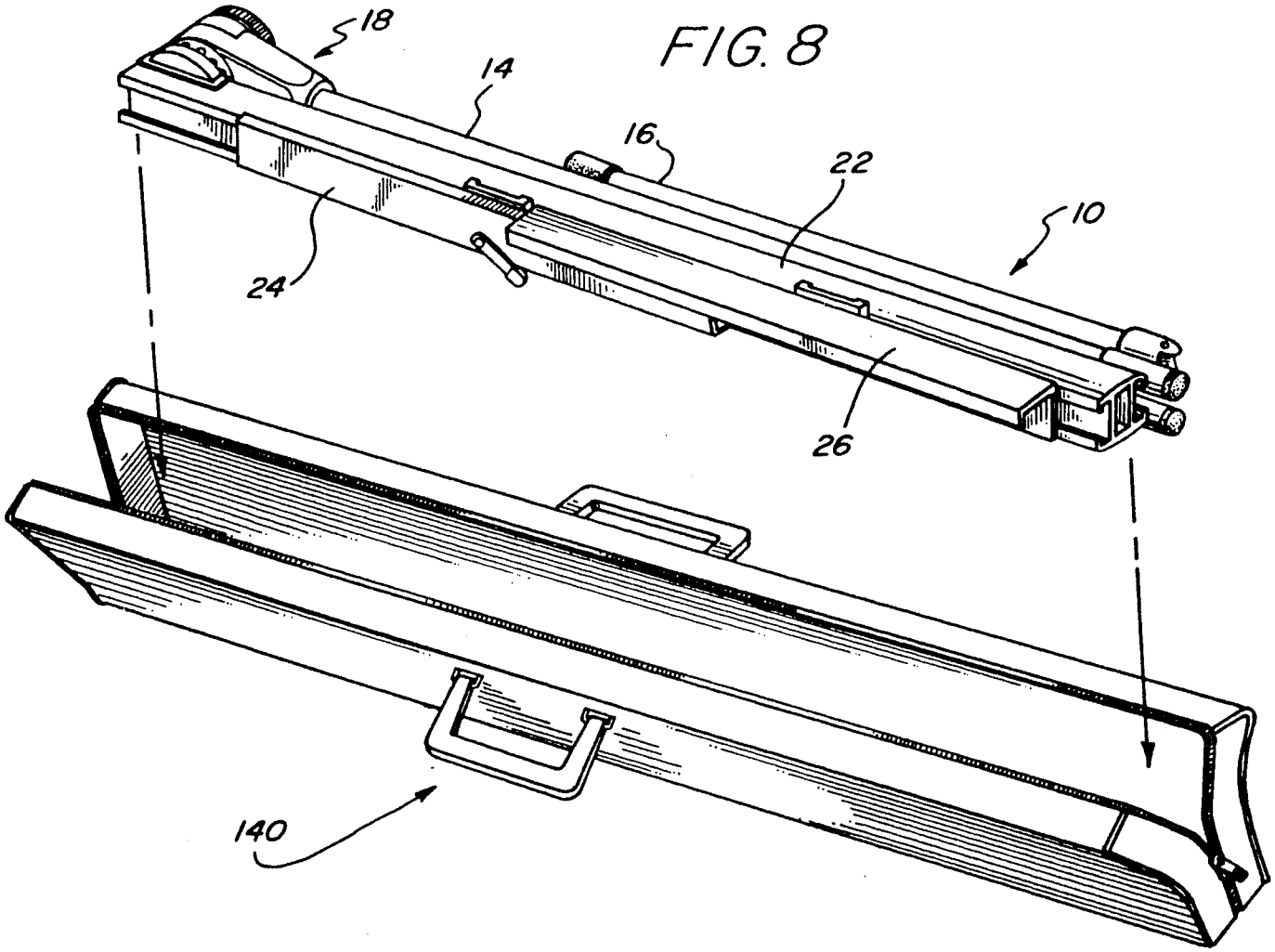
FIG. 8 is a perspective view of the display easel of FIG. 1, shown in a collapsed configuration for insertion into a carrying bag for transport.

The various hinges and pivoting and sliding attachment mechanisms of the display easel allow the easel to be folded, retracted, and collapsed into a compact transportable configuration, shown in FIG. 8. The structure of the various attachment mechanisms, along with alternative embodiments of these mechanisms, will now be discussed with reference to the remaining figures.

FIG. 2 provides a side elevational view of a lower portion of display easel 10. As can be seen, legs 14 are, in use, positioned at an angle from the vertical. Brace 22 lies parallel with legs 14.

Shelf crossbar 26 includes a rear plate 40 attached parallel to brace 22, an extending plate 42 mounted perpendicular to base plate 40, and an upwardly-extending lip or rim flange 44 extending upward from an outer edge of extending member 42. The components of shelf crossbar 26 provide a secure platform for supporting a display board.

The backward leaning angle of brace 22 assures that a display board may securely rest against brace 22. This feature is particularly desirable if the display easel is employed without clamping crossbar 24.

A lower end of leg 14 includes an end cap 46, preferably comprised of a durable and resilient material provided to prevent scraping of the floor or table upon which display easel 10 is positioned, and to prevent undue sliding of display easel 10. Foot 16 likewise includes an end cap 48.

In the embodiment of FIGS. 1 and 2, hinge 20 comprises a folding strut hinge similar to a conventional folding-table hinge. Hinge 20 includes opposing struts 50 and 52. Upper strut 50 is connected along leg 14 at a pivot point 54. Lower strut 52 is connected along leg 16 at a pivot point 56. Free ends of struts 50 and 52 are connected at pivot point 58. Foot 16 is directly mounted to leg 14 at a pivot point 60 mounted to end cap 46.

As seen in phantom lines in FIG. 2, struts 50 and 52 may be pivoted inwardly, thus allowing foot 16 to pivot upward with respect to leg 14 until parallel with leg 14. A conventional means, such as a tab or flange, is provided along strut 52 within the vicinity of pivot point 58 to secure struts 50 and 52 within the erect configuration shown in solid lines in FIG. 2.

The provision of hinge 20 allows foot 16 to be easily folded until parallel with leg 14. Although only one pivot hinge 20 is shown in FIG. 2, both legs 14 are provided with a hinge.

FIG. 3 provides a closeup cross-sectional view of clamping crossbar 24, shown attached to upper end 36 of brace 22. Base plate 28 of clamping crossbar 24 is positioned parallel with brace 22. Base plate 28 includes a perpendicularly-extending rear flange 62. Clamping plate 30 is generally angled with respect to base plate 28. Clamping plate 30 also includes a perpendicularly-rearward-extending flange 64. As can be seen from FIG. 3, rearward-extending flanges 62 and 64 lie parallel with each other. A hinge 66 connects flanges 62 and 64, thus allowing clamping plate 30 to be pulled away from base plate 28 to allow insertion of the upper edge of a display board. Hinge 66 includes a spring bias, causing clamping plate 32 to firmly close against base plate 28 to secure the display board. A tab 68 extends upwardly from clamping plate 30 to facilitate manually pivoting of clamping plate 30 away from base plate 28.

The means by which sliding attachment mechanism 32 connects brace 22 to leg connection mechanism 18 is shown in FIGS. 4 and 5. Brace 22 comprises opposing side walls 70 connected by parallel interior supports 72. Side walls 70 include flange portions 74 extending beyond side walls 70. Each pair of flanges 74 are angled slightly with respect to each other and form a pair of opposing tracks 76 with open end slots 78.

Sliding attachment mechanism 32 includes a U-shaped coupler 80, which fits snugly over the outside surfaces of one of the pairs of extending flanges 74. U-shaped coupler 80 is integrally formed with a disk-shaped base member 82. U-shaped coupler 80 extends only slightly beyond the outer circumference of disk-shaped member 82, as seen most clearly in FIG. 5. Sliding attachment mechanism 32 also includes a rectangular bore 84 extending through disk-shaped member 82 and coupler 80.

A rectangular shoulder bolt 86 extends through central bore 84 connecting track 76 of brace 22 to leg connection mechanism 18. Referring again to FIG. 4, bolt 86 includes a head 88 which is closely received within one of the tracks 76. Rectangular shoulder portion 89 extends through slot 78 and into bore 84. The dimensions of rectangular shoulder 89 are preferably chosen to snugly fit within slot 78.

Shoulder bolt 86 includes a tapped or threaded shaft 90 which extends through the remainder of disk member 82 and through leg connection mechanism 18, where it is secured, as seen in FIG. 5, by a large-diameter wing nut 90.

Thus, shoulder bolt 86 extends from track 76 of brace 22 through attachment member 32 and leg connection mechanism 18, into wing nut 90. Brace 22 may be secured to attachment member 32 at any point along the length of brace 22 by tightening shoulder bolt 86 to cause head 88 of bolt 86 to press against interior sides of flanges 74 on opposing sides of slot 78. To raise or lower brace 22, one merely loosens shoulder bolt 86 by rotating wing nut 90 until head 88 becomes slightly disengaged from flanges 74, thus allowing head 88 to slide within track 76 to an alternative location.

Track 76 extends the entire length of brace 22 such that brace 22 may be raised or lowered any arbitrary amount. The close-fitting engagement of coupler 80 with the exterior of brace 22 and shoulder 89 with the interior of track 76 ensures smooth sliding without buckling or jamming.

To further facilitate smooth sliding, one or more washers 92 may be positioned between head 88 of shoulder bolt 86 and slot 78 of track 76. Additionally, a rectangular washer 94 may be positioned between washers 92 and slot 78. Preferably, rectangular washer 94 is formed of a durable, smooth material such as polytetrafluoroethylene, sold under the trademark Teflon TM. Rectangular washer 94 is sized to be closely received within track 76 adjacent to slot 78. Rectangular washer 94 includes extending end portions 96, which extend in opposing directions along brace 22 within slot 78. Ends 96 of rectangular washer 94 further facilitate smooth sliding and prevent buckling or jamming.

Brace 22 is preferably constructed of a sturdy, but lightweight aluminum or steel material. Attachment member 32 and large-diameter wing nut 90 are preferably constructed of a durable, lightweight plastic. Large-diameter wing nut 90 includes grooves 98 formed along an outer diameter to provide a secure gripping surface. Large-diameter wing nut 90 may be provided with internal radial ribs 100 which serve to strengthen wing nut 90 to prevent damage or deformation.

Leg connection mechanism 18 will now be described with reference to FIGS. 5-7. Each leg 14 includes a pivot member 102 extending from an upper end of the leg. Each pivot member 102 includes a disk member 104 and a partial annular abutting surface 105.

Each disk member 104 includes an exterior circular surface 106 and an interior side surface 108. Each interior side surface 108 includes various tracks and tabs, discussed below. Disk members 104 include a central circular bore 110 through which shoulder bolt 86 passes.

The disk members 104 are slightly offset from longitudinal axes of the respective legs 14. That is, the center of each disk member 104 does not lie along the axis of the leg. The respective annular abutting surfaces 105 have a partially circular upper surface contiguous with outer circular surface 106 of circular member 104. Abutting surfaces 105 are centered along the longitudinal axis of each respective leg 14. However, in accordance with the offset of disk member 104, abutting surface 106 is asymmetric with respect to leg 14.

Outer circular surface 106 of the disk member of each of the legs rests against and is supported by the abutting annular surface 105 of the other leg. The interior side surfaces 108 of each leg lie mutually adjacent. In this manner, disk members 104 are coaxially positioned with exterior circular surfaces 106 combining to form a continuous cylindrical surface.

Thus, the offset of disk members 104 and the complementary shape of engaging exterior circular surfaces 106 and interior annular surfaces 105 allow the respective legs 14 to smoothly pivot and be supported by each other. Further, the offset configuration allows legs 14 to lie adjacent and parallel, as shown in FIG. 6.

Interior side surfaces 108 each include an extending tab 114 formed near the outer periphery of the side surfaces, and each include a pair of radially-extending ribs 115. Ribs 115 extend outwardly from near the center of side surfaces 105 to interior circular side walls 116. Ribs 115 are formed on an opposite sides of central bore 110 from tabs 114. Each pair of ribs 115 form a pie-shaped slot 118.

In FIG. 5, only side surface 108 of one of the legs is shown in detail. However, both side surfaces 108 are identically formed except that protruding tab 114 and ribs 115 are reversed, i.e., formed on opposite sides of central bore 110. Thus, where one side surface 108 includes a protruding tab 114, the other engaging side surface 108 includes a slot 118. Likewise, where one side surface 108 includes slot 118, the other engaging side surface includes a protruding tab 114.

With exterior circular surfaces 106 resting on annular surfaces 105, complementary side surfaces 108 engage to position tabs 114 in pie-shaped slots 118. Tabs 114 are limited to traversing only the interior of slots 118. Ribs 115 block further angular movement. The extent of angular pivoting is thereby limited by the angular extent of pie-shaped slot 118.

Figure 6:
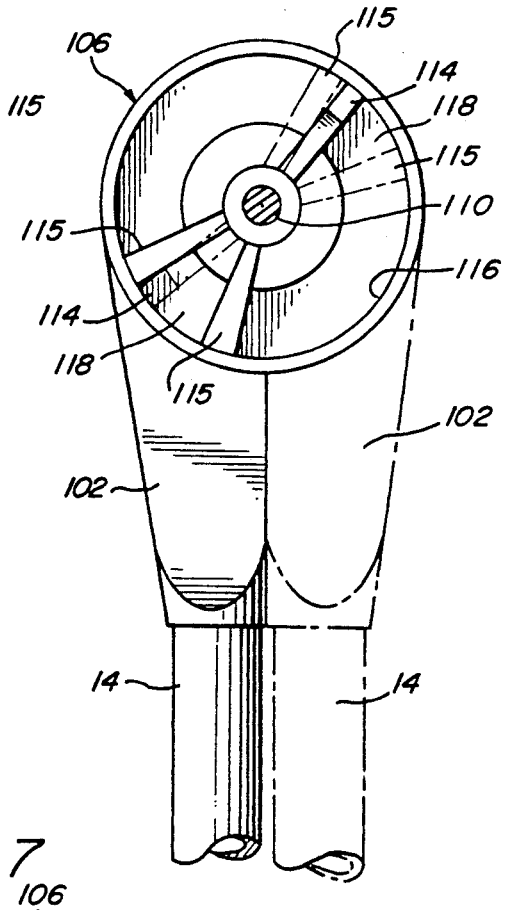
FIG. 6 is a side view, partially in phantom lines, of the pivot members of the support legs shown in FIG. 5, with the support legs being disposed parallel with each other.
Figure 7:
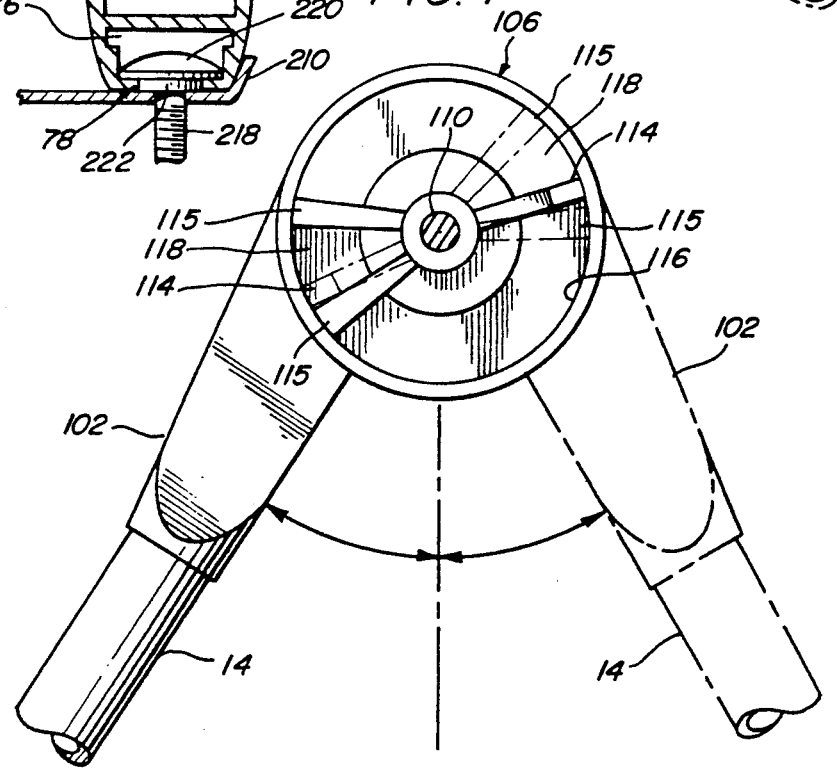
FIG. 7 is a side view, partially in phantom lines, of the pivot members of the support legs of FIG. 5, showing the support legs disposed at an angle in accordance with the erect configuration of FIG. 1.

The manner with which tabs 114 are received within slots 118 is shown more clearly in FIGS. 6 and 7, respectively showing legs 14 oriented at minimum and maximum allowed angles. In FIGS. 6 and 7, only one pivot member 102 is shown in solid lines. The other pivot member is shown in phantom lines.

Thus, legs 14 are limited to pivoting between the configuration shown in FIG. 6, wherein the legs are parallel, and the configuration of FIG. 7, wherein the legs are disposed at an angle of approximately 60 degrees. The open configuration of FIG. 7 corresponds with the expanded configuration of display easel 10 as shown in FIG. 1.

Referring again to FIG. 5, each pivot member 102 includes an exterior side surface 120 provided with a set of radially-extending slots 122. Preferably, approximately 20 slots are provided equally spaced at angles of about 18 degrees.

A coupling washer 124 is positioned between attachment member 32 and one of the pivot members 102. Coupling washer 124 includes a set of radially-extending ribs 126 provided for engaging slots 122 of exterior side surface 120 of pivot member 102. Thus, coupling washer 124 rests against exterior side surface 120. Coupling washer 124 also includes a central rectangular bore 128 for receiving shoulder bolt 86.

Coupling washer 124 includes an opposing side surface provided with radially-extending slots 130. Radially-extending slots 130 of coupling washer 124 are identical with radially-extending slots 122 of pivot member 102. Disk member 82 of sliding attachment mechanism 32 includes a side surface 132 opposite from U-shaped coupler 80. Side surface 132 includes a set of radially-extending ribs 134 which engage slots 130 of coupling washer 124. Thus, two sets of engaging ribs and slots are provided, one coupling washer 124 with pivot member 102, the other coupling sliding attachment mechanism 32 to washer 124.

The provision of the engaging slot and rib members ensures that brace 22 is secured in an upright position. Secure positioning of brace 22 is achieved by tightening large-diameter wing nut 90 onto shoulder bolt 86. By tightening wing nut 90 on bolt 86, all elements mounted to shoulder bolt 86 are likewise tightened. Thus, the engaging slots and ribs are pressed against each other. The engaging slots and ribs thereby prevent brace 22 from accidentally rotating with respect to support 12. Further, the engaging slots and ribs allow brace 22 to be alternatively oriented at various angles from the vertical. Thus, for example, as shown in FIG. 5, coupler 80 may be positioned perpendicular to legs 14 and parallel with a floor or other supporting surface. In such a configuration, brace 22 is horizontal and clamping crossbar 24 and shelf crossbar 26 are vertical. Such a horizontal configuration of brace 22 may be desirable for displaying certain display boards.

Preferably, fewer ribs are provided than slots, such that a greater angle exists between adjacent ribs and adjacent slots. This configuration allows brace 22 to be more conveniently rotated with respect to legs 14.

In an alternative embodiment (not shown), coupling washer 124 may be removed, such that side surface 132 of sliding attachment member 32 abuts directly against exterior side surface 120 of pivot member 102. However, in such an alternative embodiment, brace 22 is positionable at fewer angles. Coupling washer 124 serves to increase the number of possible angular orientations of brace 22. Further, coupling washer 124 serves to offset brace 22 from legs 14. Without coupling washer 124, brace 22 may lie too close to legs 14 and may accidentally scratch or mar the surface of legs 14.

In use, large-diameter wing nut 90 is loosened to allow legs 14 to be pivoted with respect to each other from a closed configuration wherein the legs are parallel to an open configuration wherein the legs are disposed at an angle. By further loosening wing nut 90, coupling washer 124 may be disengaged slightly from either sliding attachment member 32 or side surface 120 of pivot member 102, to thereby allow brace 22 to be pivoted to a new angle. With wing nut 90 loosened, brace 22 may also be laterally repositioned within coupler 80 by sliding brace 22.

Thus, the various pivoting and sliding attachment members allow display easel 10 to be expanded into an erect configuration (shown in FIG. 2) for displaying a display board by angularly extending legs 14, angularly extending feet 16, vertically raising brace 22, and pivoting crossbar shelf 26 and crossbar clamp 24. Alternatively, display easel 10 may be collapsed into a compact, transportable configuration (shown in FIG. 8) by pivoting crossbar clamp 24 and crossbar shelf 26 until parallel with brace 22, lowering brace 22 until a top end of brace 22 is even with pivot members 18 of support stand 12, releasing hinges 20 to pivot feet 16 until parallel with legs 14 and, finally, pivoting legs 14 with respect to each other until parallel. In the resulting compact, transportable configuration, all elements of display easel 10 lie parallel with and adjacent to adjoining elements. The collapsed easel is sufficiently small for placing within a carrying case such as case 140 shown in FIG. 8.

Referring to FIGS. 9–12, an alternative embodiment to clamping crossbar 24 is shown. Alternative clamping crossbar 200 is provided with a base plate 202 and a clamping plate 204. A pair of spring-loaded hinges 206 are provided near opposing ends of clamping crossbar 200 for connecting base plate 202 to an interior surface of clamping plate 204. Spring-loaded hinges 206 serve to secure a leading edge 208 of clamping plate 204 against base plate 202 for securing a display board. In use, clamping plate 204 is manually pivoted away from base plate 202 until a display board may be inserted between clamping plate 204 and base plate 202. A pair of posts 203 are also provided near opposing ends at receptacle 202 for engaging with mounting holes formed near a top edge of a display board.

Figure 9:
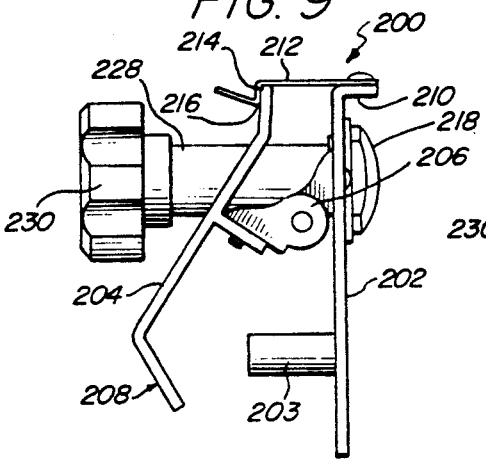
FIG. 9 is a side elevational view of an alternative clamping crossbar of the invention, shown with an open hinge.
Figure 10:
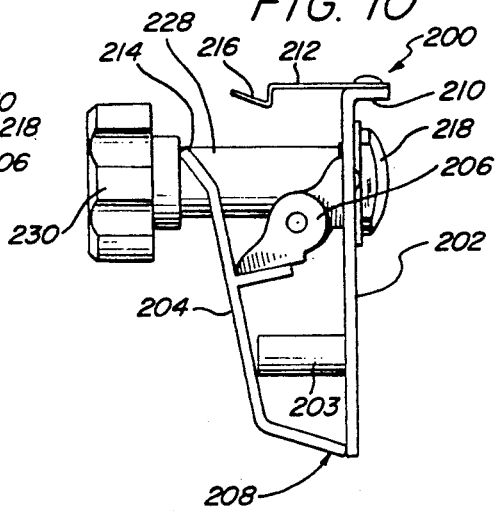
FIG. 10 is a side elevational view of the alternative clamping crossbar of FIG. 9, shown with the hinge closed.
Figure 11:
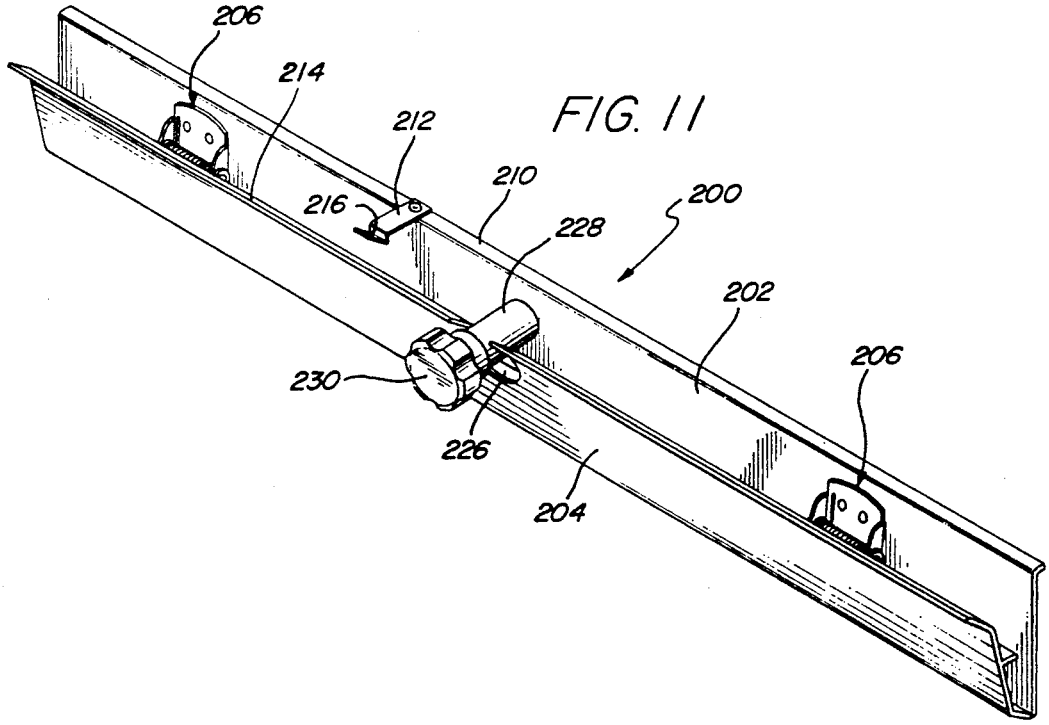
FIG. 11 is a perspective view of the alternative clamping crossbar of FIG. 9, shown with the hinge mechanism closed.

Base plate 202 includes a rearward-extending flange member 210 extending from an opposite side of base plate 202 from clamping plate 204. A securing tab 212 is mounted to flange 210 and extends outward from base plate 202 even with a rear edge 214 of clamping plate 204. Tab 212 includes a notch 216 positioned for engaging with rear edge 214 of clamping plate 204. Thus, in use, clamping plate 204 is manually pivoted away from base plate 202 until rear edge 214 engages notch 216 of tab 212, as shown in FIG. 9. In this configuration, clamping plate 204 is secured within an open position such that a display board may be easily inserted or removed. Tab 212 is resilient and may be bent slightly backwards away from rear edge 214 of clamping plate 204, thus allowing the rear edge to be disengaged from rib 216. Once disengaged, spring-loaded hinges 206 ensure that clamping plate 204 pivots forward, as shown in FIG. 10, to secure display material.

Alternative clamping crossbar member 200 is secured to brace 22 in a manner similar to which brace 22 is secured to pivot member 18 (FIG. 1), i.e., a shoulder bolt 218 is provided which extends from track 76 of brace 22 through clamping plate 200. As shown in FIG. 12, shoulder bolt 218 includes a head 220, which is closely received within track 76. Shoulder bolt 218 further includes a rectangular shoulder portion 222, which is closely received within slot 78. This allows clamping crossbar 200 to be mounted to brace 22 along a forward track 76, while brace 22 is mounted to pivot member 18 along a rear track.

Referring again to FIG. 9, shoulder bolt 218 extends through a bore formed within the center of base plate 202, and further extends through a U-shaped aperture 226 formed along rear edge 214 of clamping plate 204. A sleeve 228 extends around shoulder bolt 218 from base plate 202 to a point beyond U-shaped aperture 226. A wing nut 230 mounts to a protruding free end of shoulder bolt 218.

In use, wing nut 230 is tightened against sleeve 228, thus causing head 220 to press against the interior of slot 78 of brace 22, thus securing clamping crossbar 200 against brace 22. To pivot clamping crossbar 200, wing nut 230 is loosened. Once wing nut 230 is loosened, clamping plate 200 may pivot with respect to brace 22 or slide laterally along the length of brace 22.

Extending flange member 210 serves to limit the range of pivoting of clamping crossbar 200. Clamping crossbar 200 may be freely pivoted only when positioned at an end of brace 22. When positioned at an end of the brace, clamping crossbar 200 may be pivoted from a perpendicular orientation until parallel with the brace. When parallel, flange 210 abuts brace 22 to prevent further pivoting, shown most clearly in FIG. 12. Thus, flange 210 helps to secure clamping crossbar 200 adjacent to brace 22 when collapsed into the compact transportable configuration of FIG. 8.

When clamping crossbar 200 is mounted perpendicular to the top end of brace 22, flange 210 rests against the top edge of the brace to prevent the crossbar from sliding. However, an opening (not shown) may be provided within flange 210 at the center of clamping crossbar 200 to allow the crossbar to slide along brace 22 while the crossbar is perpendicularly extended.

Although shown and described with reference to clamping crossbar 24, the pivot mechanism and abutting flange of FIG. 12 may also be used to mount shelf crossbar 26 to a bottom end of brace 22.

Figure 13:
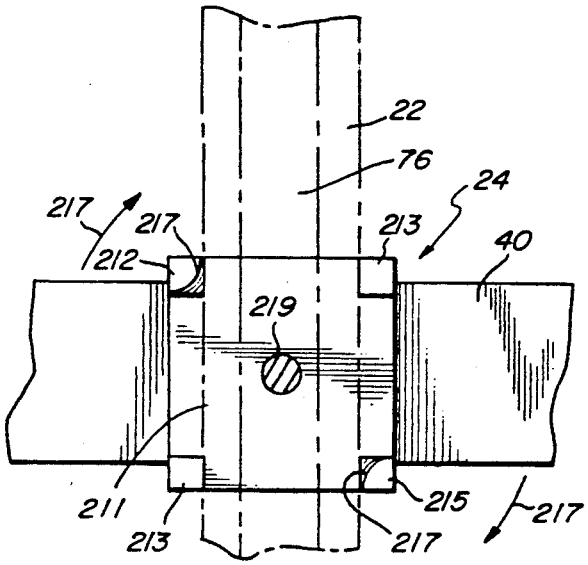
FIG. 13 is a front elevational view of the pivot connection mechanism of the shelf crossbar of FIG. 1.

An alternative pivot mechanism is shown in FIG. 13. The mechanism of FIG. 13, shown mounting shelf crossbar 24 to brace 22, is similar to the mechanism of FIG. 12 except that an abutment flange 210 is not used. Rather, a mounting plate 211 is mounted to a rear surface of base plate 40. Mounting plate 211 includes a pair of diametrically opposing tabs 213. Tabs 213 extend rearwardly to abut outside edges of brace 22 to limit pivoting of shelf crossbar 24 with respect to brace 22. Remaining corners 215 include only partially-extending tabs 217 which, during pivoting of shelf crossbar 24 along arrows 217, deflect slightly to allow crossbar 24 to pivotably traverse brace 22. Mounting plate 211 is preferably constructed of a resilient plastic or thin metal to allow for the deflection of tabs 217.

Thus, fully-extending tabs 213 limit pivoting of shelf crossbar 24, whereas partially-extending tabs 217 allow pivoting but snap to fit over brace 22 to secure shelf crossbar 24 in either an erect perpendicular configuration (FIG. 13) or a closed parallel configuration (FIG. 8). The remaining components of the pivot mechanism of FIG. 13 are similar to the components of FIG. 12 and are not shown other than a cross-sectional representation of a bolt shaft 219. The tab mechanism of FIG. 13 may also be used to secure clamping crossbar 26 to brace 22.

Referring to FIGS. 14–16, an alternative embodiment of hinge 20 and support feet 16 is shown. In FIGS. 14–16, only the lower end of a leg 14 is shown mounted to a supporting foot 16. The lower end of leg 14 terminates in a pivoting member 300, which engages with a complementarily-shaped second pivoting member 302 mounted to a forward end of support foot 16. Each pivoting member 300 and 302 includes a base portion 304 and an extending plate 306. Plates 306 are provided with smooth interior surfaces 308. Interior surface 308 of leg pivot member 300 is positioned against flat side surface 308 of foot pivot member 302. Each base member 304 includes a flat angled abutment surface 310. Each extending plate 306 includes a flat abutting side edge 312.

Each plate 306 includes a circular bore 314 extending through a corner of the plate. A bolt or other connecting member 316 passes through bores 314 and securely mounts foot member 302 to leg pivot member 306.

In use, foot 16 may be pivoted from the configuration shown in FIGS. 14 and 15, wherein foot 16 extends rearwardly at an angle from leg 14, with flat side edges 312 resting against flat angled abutment portions 310, and the configuration of FIG. 16, wherein foot 16 is pivoted forward until parallel with leg 14. In FIG. 16, the angle and direction of pivoting is shown by arrow 318. Also in FIG. 15, the extended orientation of foot 16 is represented in phantom lines.

The pivot joint of FIGS. 14–16 thus allows foot 16 to pivot smoothly and easily with respect to leg 14 without the need for a folding front hinge as shown in FIG. 1. The engaging angled flat abutting portion 310 and flat edge portions 312 allow leg 14 to be merely rested against foot 16 in an upright position such as that shown in FIG. 1. No locking mechanism is required. Further, bolt 316 need not be loosened or tightened. To position foot 16 parallel and adjacent to leg 14 in accordance with the compact, transportable configuration of FIG. 8, one merely lifts display easel 10 a sufficient height to allow leg 16 to freely pivot forward beneath leg 14 from the configuration of FIG. 15 to the closed configuration of FIG. 16. Alternatively, one may merely tilt display easel 10 to an angle, most easily accomplished once legs 14 are first collapsed into a parallel configuration, to allow foot 16 to be pivoted forward until parallel with leg 14.

Leg pivot member 300 and foot pivot member 302 are preferably constructed of a durable plastic or like material. As shown in FIGS. 15 and 16, foot 16 may be provided with an end cap 320.

Figure 17:
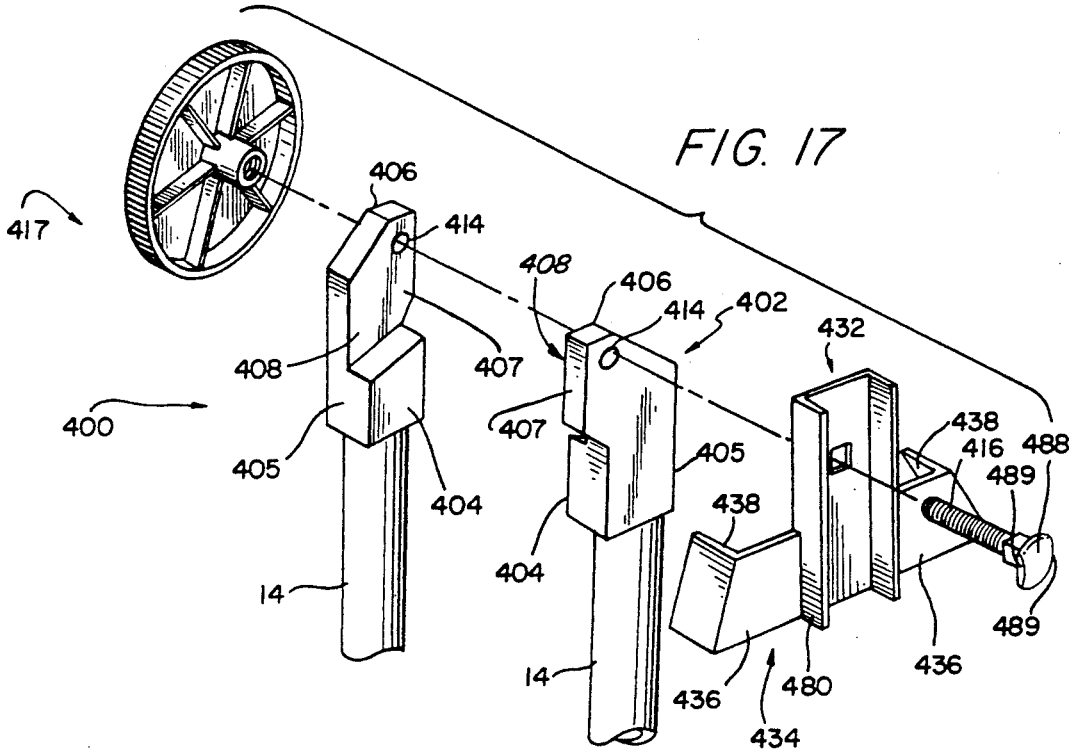
FIG. 17 provides an exploded perspective view of an alternative leg connection mechanism.
Figure 18:
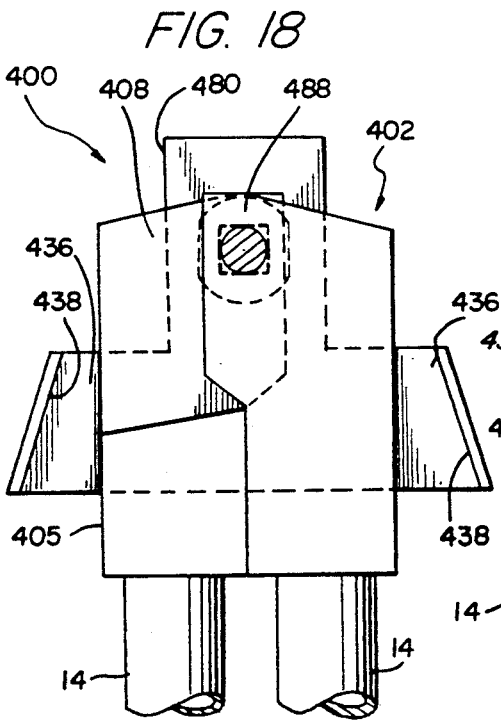
FIG. 18 provides a side elevational view of the alternative leg connection mechanism of claim 17, shown closed.
Figure 19:
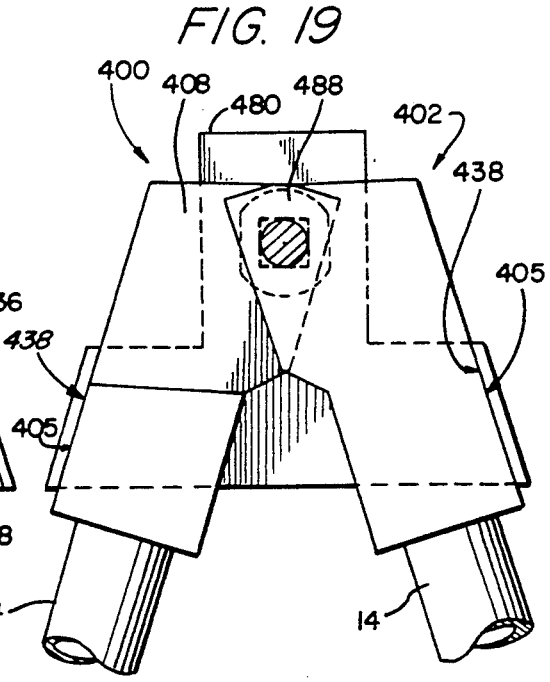
FIG. 19 provides a side elevational view of the alternative leg connection mechanism of claim 17, shown open.

Referring to FIGS. 17–19, an alternative embodiment of the leg connection mechanism of FIG. 5 is shown. In FIGS. 17–19, only the upper ends of legs 14 are shown, along with the leg connection mechanism. The upper end of each leg 14 terminates in a pivoting member, labeled 400 and 402, respectively. Pivot members 400 and 402 are complementarily shaped for engaging with each other. Each pivoting member 400 and 402 includes a base portion 404 and an extending plate 406. Plates 406 are provided with smooth interior surfaces 408.

Flat plates 406 are not symmetrically aligned with the axes of legs 14, but rather include a laterally-extending portion 407, through which a bore 414 passes. A shoulder bolt 416 passes through the bores 414 to connect pivot members 400 and 402.

On one side of the pivot members shoulder bolt 416 is received and secured within a large-diameter wing nut 417. On the opposing sides of the pivot members, shoulder bolt 416 secures a coupling member 432. Coupling member 432 includes a U-shaped track 480 for receiving brace 22 (not shown). As with the embodiments discussed above, a head of the shoulder bolt engages with a track within brace 22 for slidably attaching brace 22 to the leg connection mechanism. Head 488 of shoulder bolt 416 may include flat edges 489 for engaging with interior side walls of the track of brace 22. Flat edges 489 may be formed by cutting opposing sides of an initially circular shoulder bolt.

Coupling member 432 includes a clamping bracket 434 having opposing wing members 436, with each wing member 436 including an interior angled surface 438. The opposing interior angled surfaces 438 generally form a V-shaped bracket for limiting the pivoting movement of legs 14.

Each base member 404 of pivoting members 400 and 402 includes an outer flat edge 405. In use, as legs 14 are pivoted outwardly, outer edges 405 abut inner angled surfaces 438, thus limiting the range of pivoting of the legs. Legs 14 may be secured in the open position by tightening large-diameter wing nut 417 onto shoulder bolt 416. To pivot the legs until parallel, one merely loosens large-diameter wing nut 417 until legs 14 pivot freely to a parallel configuration wherein legs 14 are adjacent.

The closed configuration, wherein the legs are parallel as shown in FIG. 18, whereas the open configuration, wherein the legs are disposed at an angle, is shown in FIG. 19.

In any of its various embodiments, the display easel of the invention provides a lightweight, yet sturdy display easel for displaying material such as display boards. The various components of the display easel may be easily repositioned in a variety of configurations to facilitate displaying a wide range of material sizes and shapes. Further, the various components of the display easel may be quickly and easily collapsed into a compact configuration for easy transport. No tools or other devices are required for setting up the easel or for collapsing the easel. Rather, the various components are joined by sliding and pivoting attachment mechanisms which allow smooth and convenient extension or contraction of the easel. Conveniently positioned, manually rotatable wing nuts are provided for tightening or loosening the various sliding and pivoting attachments.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

We claim:

1. A collapsible display easel comprising:

two, and only two, support legs;

leg connection means for pivotably connecting one leg to the other;

a brace;

brace mounting means for slidably mounting the brace to the legs; and one or more crossbars having means for holding a display board, a crossbar mounting means provided with each respective crossbar for pivotably mounting each respective crossbar to the brace, the legs pivoting within a plane generally parallel to said brace and crossbars between an extended position wherein the legs are disposed at an angle with respect to each other for standing on a surface, to a collapsed configuration, wherein the legs are parallel to each other and parallel to the brace;

wherein the legs each have a foot, each foot being connected to a lower end of a respective leg by a hinge means for varying an angle between the leg and the foot from a extended position, wherein the foot extends rigidly outward from the leg for supporting the leg, and a contracted position wherein the foot is disposed parallel to the leg;

with the easel being expendable into an erect configuration for holding a display board and collapsible into a compact configuration for transport.

2. The collapsible display easel of claim 1, wherein the crossbar mounting means of each respective crossbar further includes crossbar sliding attachment means for sliding the respective crossbar along the length of the brace to allow the crossbar to be positioned at selected points along the brace.

3. The collapsible display easel of claim 2, wherein the crossbar sliding attachment means comprises:

a track formed longitudinally along an edge of the brace, the track having a slot extending longitudinally therewith; and a shoulder bolt having a rectangular shoulder, the shoulder bolt being releasably mounted to the respective crossbar; with a head of the shoulder bolt being slidably received in the track, and the rectangular shoulder of the bolt being closely received within the slot.

4. The collapsible display easel of claim 3, wherein one or more of the crossbars includes a means for preventing pivoting of the crossbar with respect to the brace while the crossbar is disposed other than near an end of the brace.

5. The collapsible display easel of claim 1, wherein the brace mounting means comprises:

a track formed longitudinally along an edge of the brace, the track having a narrow slot extending longitudinally therewith; and a shoulder bolt having a rectangular shoulder and a round head, the shoulder bolt being releasably mounted to the legs, with the head of the shoulder bolt being slidably received in the track, the head of the shoulder bolt having squared-off opposing edges disposed against opposing inner surfaces of the track, and the rectangular shoulder of the bolt being closely received within the slot.

6. The collapsible display easel of claim 1, wherein one of the crossbars includes a shelf, the shelf being oriented for receiving and holding a display board while the crossbar is oriented in an extended position perpendicular to the brace with the crossbar positioned near a bottom end of the brace.

7. The collapsible display easel of claim 1, wherein one of the crossbars includes a clamp means, the clamp being oriented for holding a depending display board while the crossbar is oriented in an extended position perpendicular to the brace with the crossbar positioned near a top end of the brace.

8. The collapsible display easel of claim 1, wherein the leg connection means comprises a pair of pivot members mounted to top ends of the legs, the pivot members each having an outward-facing cylindrical surface, a disk surface, and an inward-facing annular surface, the cylindrical surface of each leg abutting the annular surface of the other leg, with a releasable bolt being mounted through the pivot members connecting the pivot members to each other.

9. The collapsible display easel of claim 1, wherein the hinge means connecting a respective foot to a respective leg comprises a folding-strut hinge.

10. The collapsible display easel of claim 1, wherein the hinge means connecting a respective foot to a respective leg comprises a pivot joint having a first pivot member attached to the lower end of each leg, a complementary pivot member attached to an inner end of the respective foot, each pivot member having a flat side surface and an angled abutting surface, the flat side surface of the pivot member of the foot being connected to the flat side surface of the pivot member of the respective leg for pivoting in a plane parallel to the side surfaces between a first position wherein the foot is parallel and adjacent to a front edge of the leg, and a second position wherein the abutting surface of the pivot member of the foot abuts the abutting surface of the pivot member of the leg at an obtuse angle from the first position, with said leg leaning against and being supported by the abutting surface of the foot.

11. The collapsible display hinge of claim 7, wherein the crossbar is pivotably mounted at its center to the brace, and wherein the crossbar includes:

a flat base plate;

a clamping plate hingeably connected to a front surface of the base plate; and a tab extending from the base plate for releasably securing the clamping plate in an open position, with the tab being offset longitudinally from the center of the crossbar, and with the clamping plate having a slot formed at its center for allowing free pivoting of the clamping plate without interference from the crossbar mounting means.

12. The collapsible display easel of claim 8, wherein the pivot members include abutting interior side circular surfaces, each of the interior side surfaces being provided with an extending tab, each tab extending into a slot formed in the side interior surface of the abutting pivot member, the tab traversing the slot during pivoting, the slots having blocked ends to limit angular movement of the tabs to limit the angular extent of pivoting of the pair of legs.

13. The collapsible display easel of claim 12, wherein each of the pivot members includes an external side circular surface, the external side circular surface of at least one of the pivot members having a plurality of equally-spaced radial slots;

and wherein the brace is provided with a coupling member, the coupling member having a circular side surface with equally-spaced radial ribs for engaging the slots of the external side circular surface;

and wherein a head of the releasable bolt is received in a slotted edge of the brace, a shaft of the brace extending through the coupling member and the pivot members into a nut for securing and tightening the bolt;

the engaging slots and ribs being provided to secure the brace to the pivot members at discrete angles between a first position wherein the brace is perpendicular to the legs and a second position wherein the brace is parallel to the legs.

14. The collapsible display easel of claim 13, further including a washer member provided between the coupling member and the slotted side surface of the slotted pivot member, the washer member having a first side provided with equally-spaced radial ribs and a second side provided with equally-spaced radial slots, with the ribs of the washer engaging the slots of the pivot member, and the slots of the washer engaging the ribs of the coupling member, the washer having twice as many slots as ribs.

15. In a collapsible display easel having a brace mounted to a support stand, the improvement being that the support stand comprises a pair of support legs pivotably attached to each other at upper ends thereof, the support legs pivotably between an extended position wherein the legs are disposed at an angle with respect to each other and a collapsed position wherein the legs are adjacent and parallel to each other, the improvement further comprising that the legs each have a foot, each foot being connected to a lower end of a respective leg by a hinge means for varying an angle between the leg and the foot from an extended position, wherein the foot extends outward from the leg for supporting the leg, and a collapsed position, wherein the foot is disposed parallel to the leg, and wherein the pair of support legs are pivotably attached to each other by a pivot joint having a first pivot member attached to an upper end of a first leg of the pair, a complementary pivot member attached to an upper end of a second leg of the pair, each pivot member having a flat side surface, the flat side surface of the pivot member of the first leg being pivotably connected at a pivot point of the pivot member at the second leg for pivoting in a plane parallel to the side surfaces, the pivot joint having means for limiting outward pivoting of the legs with respect to each other.

16. The collapsible display easel of claim 15, wherein the means for limiting pivoting comprises a bracket member having angled interior surfaces, the bracket member being pivotably connected to the pivot members at the pivot point, the bracket member allowing the legs to pivot between a first position wherein the legs are parallel and adjacent, and a second position wherein the flat side surface of the pivot member of the first leg abuts a first angled interior surface of the bracket member, and the flat side surface of the pivot member of the second leg abuts a second angled interior surface of the bracket member to limit the angular extent of the pivoting of the legs with respect to each other.

17. A collapsible display easel comprising:

a pair of support legs;

leg connection means for pivotably connecting one leg to the other;

a brace;

brace mounting means for slidably mounting the brace to the legs;

one or more crossbars having means for holding a display board, a crossbar mounting means provided with each respective crossbar for pivotably mounting each respective crossbar to the brace;

with the easel being expandable into an erect configuration for holding a display board and collapsible into a compact configuration for transport;

wherein the legs each have a foot, each foot being connected to a lower end of a respective leg by a hinge means for varying any angle between the leg and the foot from a extended position wherein the foot extends rigidly outward from the leg for supporting the leg, and a collapsed position wherein the foot is disposed parallel to the leg; and wherein the hinge means connecting a respective foot to a respective leg comprises a pivot joint having a first pivot member attached to the lower end of each leg, a complementary pivot member attached to an inner end of the respective foot, each pivot member having a flat side surface and an angled abutting surface, the flat side surface of the pivot member of the foot being connected to the flat side surface of the pivot member of the respective leg for pivoting in a plane parallel to the side surfaces between a first position wherein the foot is parallel and adjacent to a front edge of the leg, and a second position wherein the abutting surface of the pivot member of the foot abuts the abutting surface of the pivot member of the leg at an obtuse angle from the first position, with said leg leaning against and being supported by the abutting surface of the foot.

18. A collapsible display easel comprising:

a pair of support legs;

leg connection means for pivotably connecting one leg to the other;

a brace;

brace mounting means for slidably mounting the brace to the legs;

one or more crossbars having means for holding a display board, a crossbar mounting means provided with each respective crossbar for pivotably mounting each respective crossbar to the brace;

with the easel being expandable into an erect configuration for holding a display board and collapsible into a compact configuration for transport;

wherein one of the crossbars includes a clamp means, the clamp being oriented for holding a depending display board while the crossbar is oriented in an extended position perpendicular to the brace with the crossbar positioned near a top end of the brace; and wherein the crossbar is pivotably mounted at its center to the brace and includes a flat base plate, a clamping plate hingeably connected to a front surface of the base plate, and a tab extending from the base plate for releasably securing the clamping plate in an open position, with the tab being offset longitudinally from the center of the crossbar, and wit the clamping plate having a slot formed at its center for allowing free pivoting of the clamping plate without interference from the crossbar mounting means.

19. A collapsible display easel comprising:

a pair of support legs;

leg connection means for pivotably connecting one leg to the other;

a brace;

brace mounting means for slidably mounting the brace to the legs;

one or more crossbars having means for holding a display board, a crossbar mounting means provided with each respective crossbar for pivotably mounting each respective crossbar to the brace;

with the easel being expandable into an erect configuration for holding a display board and collapsible into a compact configuration for transport; and wherein the leg connection means comprises a pair of pivot members mounted to top ends of the legs, the pivot members each having an outward-facing cylindrical surface, a disk surface, and an inward-facing annular surface, the cylindrical surface of each leg abutting the annular surface of the other leg, with a releasable bolt being mounted through the pivot members connecting the pivot members to each other.

20. The collapsible display easel of claim 19, wherein the pivot members include abutting interior side circular surfaces, each of the interior side surfaces being provided with an extending tab, each tab extending into a slot formed in the side interior surface of the abutting pivot member, the tab traversing the slot during pivoting, the slots having blocked ends to limit angular movement of the tabs to limit the angular extent of pivoting the pair of legs.

21. The collapsible display easel of claim 20, wherein each of the pivot members includes an external side circular surface, the external side circular surface of at least one of the pivot members having a plurality of equally-spaced radial slots;

wherein the brace is provided with a coupling member, the coupling member having a circular side surface with equally-spaced radial ribs for engaging the slots of the external side circular surface;

wherein a head of the releasable bolt is received in a slotted edge of the brace, a shaft of the brace extending through the coupling member and the pivot members into a nut for securing and tightening the bolt; and wherein the engaging slots and ribs are provided to secure the brace to the pivot members at discrete angles between a first position wherein the brace is perpendicular to the legs and a second position wherein the brace is parallel to the legs.

22. The collapsible display easel of claim 21, further including a washer member provided between the coupling member and the slotted side surface of the slotted pivot member, the washer member having a first side provided with equally-spaced radial ribs and a second side provided with equally-spaced radial slots, with the ribs of the washer engaging the ribs of the coupling member, the washer having twice as many slots as ribs.

* * * * *

UNITED STATES PATENT AND TRADEMARK OFFICE

CERTIFICATE OF CORRECTION

PATENT NO. : 5,205,526

DATED : April 27, 1993

INVENTOR(S) : Dennis Deutsch, et al

It is certified that error appears in the above-indentified patent and that said Letters Patent is hereby corrected as shown below:

On the title page, Item [75]: Inventors should read:

--Dennis Deutsch, Hastings Minnesota;
Lindsay A. Brown, Irvine, California--.

Signed and Sealed this

Fourth Day of January, 1994

Bruce Lehman

*Attest:*

BRUCE LEHMAN

*Attesting Officer*

*Commissioner of Patents and Trademarks*